US009764807B2

(12) United States Patent
Frisbie et al.

(10) Patent No.: US 9,764,807 B2
(45) Date of Patent: Sep. 19, 2017

(54) MARINE VESSEL DISPLAY SYSTEM HAVING AUTOMATIC SELECTION OF MODE OF OPERATION

(71) Applicant: Garmin Switzerland GmbH, Schaffhausen (CH)

(72) Inventors: Michael S Frisbie, Lenexa, KS (US); Ravinder Singh, Olathe, KS (US)

(73) Assignee: Garmin Switzerland GmbH (CH)

( * ) Notice: Subject to any disclaimer, the term of this patent is extended or adjusted under 35 U.S.C. 154(b) by 0 days.

(21) Appl. No.: 15/003,244

(22) Filed: Jan. 21, 2016

(65) Prior Publication Data

US 2017/0210449 A1 Jul. 27, 2017

(51) Int. Cl.
*B63B 49/00* (2006.01)

(52) U.S. Cl.
CPC ..... *B63B 49/00* (2013.01)

(58) Field of Classification Search
CPC ..... B63B 49/00
See application file for complete search history.

(56) References Cited

U.S. PATENT DOCUMENTS 7,143,363 B1 * 11/2006 Gaynor ..... B63J 99/00 340/461
2007/0008186 A1 * 1/2007 Michaels ..... B63B 49/00 340/945
2013/0271301 A1 * 10/2013 Kabel ..... B63B 49/00 340/987

* cited by examiner

*Primary Examiner* — Anne M Antonucci
(74) *Attorney, Agent, or Firm* — Samuel M. Korte; Max M. Ali

(57) ABSTRACT

A display system for a marine vessel implements a plurality of modes of operation, each of which presents information representative of data from selected marine input sources on one or more electronic displays of the system. A mode of operation may be selected automatically when a determination is made that the marine vessel is within a geographic area, defined by a boundary, or crosses a boundary line with which the mode of operation is associated.

18 Claims, 12 Drawing Sheets

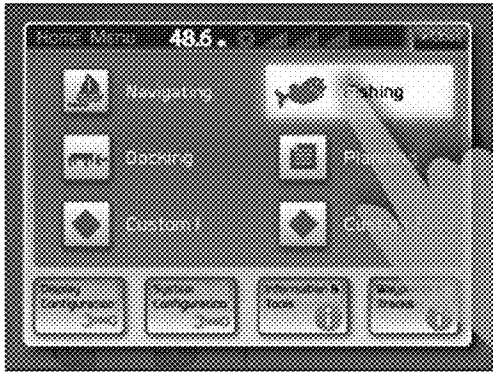
FIG. 9
FIG. 10
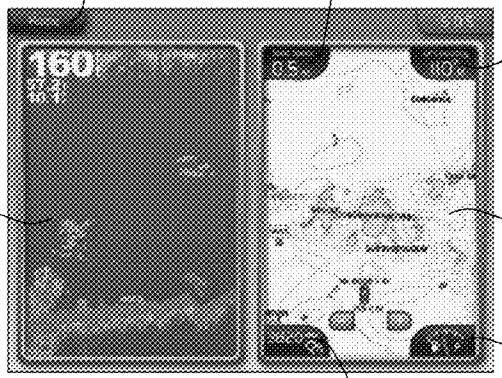
FIG. 11

MARINE VESSEL DISPLAY SYSTEM HAVING AUTOMATIC SELECTION OF MODE OF OPERATION

BACKGROUND

Marine vessels often employ numerous instruments, controls, displays and gauges for allowing operators to view cartographic maps, navigate to desired locations, locate fish and other underwater objects, monitor fuel levels and other vessel conditions, and perform other control and monitoring functions. To reduce dashboard clutter and simplify operation, marine vessels are increasingly being equipped with one or more multi-function electronic displays that replace many of the individual instruments, controls, and gauges.

SUMMARY

The present disclosure is directed to technology that encompasses a display system for a marine vessel (hereinafter referred to as a "marine vessel display system") having "smartmode boundaries." The marine vessel display system implements a plurality of modes of operation, each of which presents information representative of data from selected marine input sources on one or more electronic displays of the system and/or comprises snapshots of settings to be applied to various software, hardware and/or peripherals within or related to the marine vessel and/or its systems. The mode of operation may be selected automatically when based on a comparison of the current geographic position of the marine vessel to the first geographic area with which the mode of operation is associated.

In one or more embodiments, the marine vessel display system includes a memory including geographic position data for a geographic area; a position determining component such as a global positioning system receiver, or the like, for determining a current geographic position of the marine vessel; a display; and a processing system operable to implement a plurality of modes of operation for the marine vessel display system. The processing system is configured to select a mode of operation based on a comparison of the current geographic position of the marine vessel to the geographic area. The processing system then causes the display to present information related to the selected mode of operation and/or change settings of various software, hardware and/or peripherals within or related to the marine vessel and/or its systems in accordance with the selected mode of operation. The processing system may further facilitate the identification of geographic areas with which one or more modes of operation may be associated.

In one or more embodiments, the marine vessel display system comprises one or more display stations configured to be mounted in the marine vessel, each including a plurality of displays. The marine vessel display system includes a memory including geographic position data for a geographic area; a position determining component such as a global positioning system receiver, or the like, for determining a current geographic position of the marine vessel, a display, and a processing system operable to implement a plurality of modes of operation for the marine vessel display system. The processing system is configured to select a mode of operation based on a comparison of the current geographic position of the marine vessel to the geographic area. The processing system then causes one or more of the plurality of displays of the display station to present information related to the selected mode of operation and/or change settings of various software, hardware and/or peripherals within or related to the marine vessel or its systems in accordance with the selected mode of operation. The processing system may further facilitate the identification of geographic areas with which one or more modes of operation may be associated.

The technology encompassed by the present disclosure may further comprise a method for controlling a marine vessel having a marine vessel display system including at least one display. In one or more embodiments, geographic position data for a geographic area is retrieved from a memory. A current geographic position of the marine vessel is received from a position determining component. A mode of operation for the marine vessel display system may be selected from a plurality of modes of operation based on a comparison of the current geographic position of the marine vessel to the geographic area, whereupon the processing system causes the displays of the display system to present information related to the selected mode of operation and/or change settings of various software, hardware and/or peripherals within or related to the marine vessel or its systems in accordance with the selected mode of operation.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present technology will be apparent from the following detailed description of the embodiments and the accompanying drawing figures.

BRIEF DESCRIPTION OF THE DRAWING FIGURES

The detailed description is described with reference to the accompanying figures. The use of the same reference numbers in different instances in the description and the figures may indicate similar or identical items.

FIG. 9 is a diagrammatic view illustrating an example screen display of the marine vessel display system of FIG. 1.

FIG. 10 is a diagrammatic view illustrating an example screen display of the marine vessel display system of FIG. 1.

FIG. 11 is a diagrammatic view illustrating an example screen display of the marine vessel display system of FIG. 1.

Figure 1:
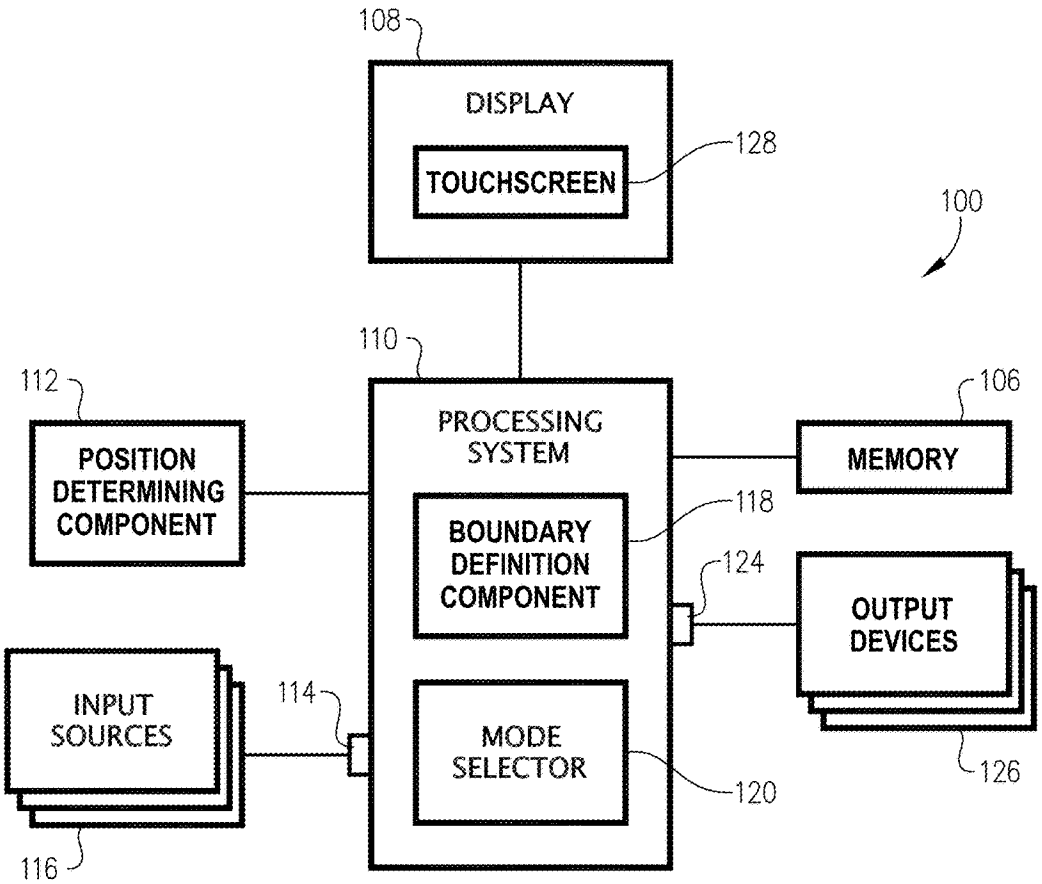
FIG. 1 is a block diagram illustrating example components of a marine vessel display system constructed in accordance with an embodiment of the technology.

The drawing figures do not limit the present technology to the specific embodiments disclosed and described herein. The drawings are not necessarily to scale, emphasis instead being placed upon clearly illustrating the principles of the technology.

DETAILED DESCRIPTION

The present technology is directed to a marine vessel display system that is more efficient and intuitive to use. The marine vessel display system may implement a plurality of modes of operation, each of which may present information representative of data from selected marine input sources on one or more electronic displays and/or snapshots of settings to be applied to various software, hardware and/or peripherals within or related to the marine vessel and/or its systems. The marine vessel display system may allow the boundaries of one or more geographic areas to be defined, and the defined geographic areas to be associated with respective modes of operation. The marine vessel display system may then automatically select a predetermined mode of operation when the marine vessel enters the geographic area (e.g., crosses the boundary of the geographic area) with which the mode of operation is associated. The marine vessel display system thus may facilitate more efficient access to data related to a particular mode of operation without being burdened with data unrelated to the selected mode and without having to locate and monitor multiple individual instruments, gauges, read-outs, etc. The user may also switch between modes of operation manually to monitor information related to other modes of operation.

Embodiments of the technology may provide a marine vessel display system that includes a position determining component such as a global positioning system receiver, or the like, for providing geographic position data for the marine vessel; a display; a processing system operable to implement a plurality of modes of operation; and a mode selector. The mode selector may be configured to select a mode of operation when the geographic position data received from the position determining component indicates that the marine vessel is within a geographic area (e.g., when the geographic position data indicates that the marine vessel has crossed the boundary into the geographic area, when the geographic position data indicates that the marine vessel has been powered on within the geographic area, and so on). The processing system may then cause the display to present information related to the selected mode of operation and/or cause the settings of various software, hardware and/or peripherals within or related to the marine vessel and its systems to be changed in accordance with the selected mode of operation. A boundary definition component may facilitate the definition of one or more boundaries of geographic areas or boundary lines (such as the start line for a sailing race) with which one or more modes of operation are associated.

In embodiments of the technology, the marine vessel display system may include a plurality of independent displays mounted adjacent to one another to form a display station. One of the displays in the display station may include an input device such as a touchscreen user interface and may be designated as a primary control display. A processing system coupled with the displays may implement a plurality of modes of operation as described above. A position determining component such as a global positioning system receiver, or the like, may provide geographic position data for the marine vessel. A mode selector may be configured to select a mode of operation when the geographic position data received from the position determining component indicates that the marine vessel is within a geographic area (e.g., when the geographic position data indicates that the marine vessel has crossed the boundary into the geographic area, when the geographic position data indicates that the marine vessel has been powered on within the geographic area, and so on). The processing system may then cause the display to present information related to the selected mode of operation and/or cause the settings of various software, hardware and/or peripherals within or related to the marine vessel and its systems to be changed in accordance with the selected mode of operation. In this manner, the marine vessel display system can automatically switch between the modes of operation and otherwise control all of the displays in the display station so that all the displays in the display station act as a collective unit without requiring configuration by the user. Additionally or alternatively, the marine vessel display system can automatically switch between snapshots of settings associated with modes of operation and control various software, hardware and/or peripherals within or related to the marine vessel and its systems.

Other embodiments of the technology may provide a marine vessel display system in which multiple display stations as described above are mounted in different locations of a marine vessel to permit boat operators to access data from several locations. For example, a first display station may be mounted in the cockpit of a marine vessel and a second display station may be mounted near an aft station of the same marine vessel. The mode selector may select different modes of operation for each of the display stations so that each display station may be configured to monitor particular marine input sources. Configuration data, user preferences, and other data and information provided to one of the display stations may be shared with all the display stations to ensure users are provided with current information at all the stations or such data and information may be specific to each station.

Referring now to FIGS. 1 through 17, a marine vessel display system 100 configured in accordance with example embodiments of the present technology is described in more detail. Generally, the marine vessel display system 100 may be configured to be mounted in a marine vessel 102 such as a boat, ship, sailboat, or other watercraft, as shown in FIG. 3. The marine vessel display system 100 may assist users such as operators of the marine vessel 102, passengers, or the like, in monitoring information related to the operation of the marine vessel 102.

FIG. 1 illustrates an example embodiment of the marine vessel display system 100. As shown, the marine vessel display system 100 broadly comprises at least one input 114 for receiving data from one or more marine input sources 116; a display 108 for presenting information representative of at least some of the data from the marine input sources 116; and a processing system 110 in communication with the inputs 114 and the display 108. As described in more detail below, the processing system 110 may implement a plurality of modes of operation, each of which may cause the display 108 to present information representative of data from selected ones of the marine input sources 116 and in selected formats. The marine vessel display system 100 may further comprise a position determining component 112 that furnishes geographic position data for the marine vessel 102; a boundary definition component 118 that facilitates the definition of the boundaries of geographic areas with which one or more modes of operation are associated; and a mode selector 120 configured to select between a plurality of modes of operation, respective ones of which present information representative of data from selected marine input sources 116 on the display 108.

The input 114 may be any wireless or wired device or devices for receiving data from the marine input sources 116 and transferring the data to the processing system 110. The input 114 may comprise, for example, one or more Ethernet ports, Universal Serial Bus (USB) Ports, High Definition Multi-Media Interface (HDMI) ports, memory card slots, video ports, radio frequency (RF) receivers, infrared (IR) receivers, Wi-Fi receivers, Bluetooth devices, and so forth.

The marine input sources 116 may provide data to the processing system 110 and may comprise any measurement devices, sensors, receivers, or other components that sense, measure, or otherwise monitor components of the marine vessel 102 or its surroundings. For example, the marine input sources 116 may include sensors that measure or sense vessel fuel level, wind speed, wind direction, vessel temperature, ambient temperature, water current speed, rudder position, an azimuth thruster position, water depth, boat water storage level, anchor status, boat speed, and the like. The marine input sources 116 may also include an integrated or external sonar sounder coupled with a sonar transducer and an integrated or external radar scanner or other proximity sensor.

The marine input sources 116 may also include transmitters, receivers, transceivers, and other devices that receive data from external sources. For example, the marine input sources 116 may include an integrated or external weather receiver for receiving weather data from a weather source, a satellite entertainment system receiver for receiving entertainment content broadcast via satellite, and/or a global positioning system (GPS) receiver or other satellite navigation receiver for receiving navigation signals.

The marine input sources 116 may also comprise a receiver or other device for communicating with transmitters or other devices worn by passengers on the marine vessel 102 to warn of "man overboard" emergencies or the like.

The marine input sources 116 may also comprise a security system for monitoring, ports, doors, windows, and other parts of the marine vessel 102 against unauthorized access and one or more cameras for providing video and/or other images of the marine vessel 102 and/or the marine vessel's 102 surroundings.

The marine input sources 116 may comprise one or more computers and/or handheld electronic devices that may be used to transfer data to the marine vessel display system 100. The marine input sources 116 may be integrally formed with the marine vessel display system 100, may be stand-alone devices, or may be a combination of both. For example, a sonar sounder may be integrated into the marine vessel display system 100 or may be an external sonar sounder module. Similarly, a radar scanner may be integrated into the marine vessel display system 100 or be an external device. The marine input sources 116 may be operated and/or adjusted using controls on the marine vessel display system 100 or may have their own controls. The marine input sources 116 may be operated and/or adjusted automatically when changing from one mode of operation to another mode of operation.

The display 108 may be coupled with the processing system 110 and may be configured for displaying text, data, graphics, images and other information representative of data from the marine input sources 116 and/or other sources. The display 108 may be a liquid crystal display (LCD), light-emitting diode (LED) display, light-emitting polymer (LEP) display, thin film transistor (TFT) display, gas plasma display, or any other type of display. The display 108 may be backlit such that it may be viewed in the dark or other low-light environments. The display 108 may be of any size and/or aspect ratio, and in one or more embodiments, may be 15 inches, 17 inches, 19 inches, or 24 inches (measured diagonally). In some embodiments, the display 108 may include a touchscreen control system. The touchscreen control system may use any touchscreen technology such as resistive, capacitive, or infrared touchscreen technologies, or any combination thereof.

The processing system 110 may control the presentation of information on the display 108, may perform other functions described herein, and can be implemented in hardware, software, firmware, or a combination thereof. The processing system 110 may include any number of processors, controllers, microprocessors, microcontrollers, programmable logic controllers (PLCs), field-programmable gate arrays (FPGAs), application specific integrated circuits (ASICs), or any other component or components that are operable to perform, or assist in the performance of, the operations described herein.

The processing system 110 may also be coupled to or include memory 106 for storing instructions or data. The memory 106 may be a single component or may be a combination of components that provide the requisite storage functionality. The memory 106 may include various types of volatile or non-volatile memory such as flash memory, optical discs, magnetic storage devices, SRAM, DRAM, or other memory devices capable of storing data and instructions. The memory 106 may communicate directly with the processing system 110, or may communicate over a data bus or other mechanism that facilitates direct or indirect communication. The memory 106 may optionally be structured with a file system to provide organized access to data existing thereon.

The memory 106 may store one or more databases that may include information about the marine vessel 102 in which the marine vessel display system 100 is used, such as the marine vessel's 102 length, width, weight, turning radius, top speed, draft, minimum depth clearance, minimum height clearance, water capacity, fuel capacity and/or fuel consumption rate. The databases may also store information related to the locations and types of navigational aids including buoys, markers, lights, or the like. In some embodiments, the information related to navigational aids may be provided by the Coast Guard or other map data sources.

The processing system 110 may implement one or more computer programs that provide the modes of operation described below and that control the display of information on the display 108 as described herein. The computer programs may comprise ordered listings of executable instructions for implementing logical functions in the processing system 110. The computer programs can be embodied in any non-transitory computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any non-transitory means that can contain, store, communicate, propagate or transport the program for use by or in connection with the processing system 110 or other instruction execution system, apparatus, or device. The computer-readable medium can be, for example, but not limited to, an electronic, magnetic, optical, electro-magnetic, infrared, or semi-conductor system, apparatus, device, or propagation medium. More specifically, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

In accordance with the present disclosure, the processing system 110 may implement a plurality of modes of operation, each of which may present information representative of data from selected marine input sources 116 via the display 108. In some embodiments, the information may be presented in a desired format to minimize confusion and increase ease of use. For example, the processing system 110 may implement a pre-trip planning mode in which information representative of trip planning data is presented on the display 108. The trip planning data may be uploaded, transmitted, or otherwise communicated to the marine vessel display system 100 from one or more marine input sources 116 and may include route planning data; waypoint data; journey plans; forecasted wind, current, storm, and/or tidal conditions; vessel fuel requirements; vessel water requirements; and other data that may be useful to an operator while planning a journey. The pre-trip planning mode may permit an operator to create a journey plan or similar plan on a remote or local computer and then transfer information related to the plan to the marine vessel display system 100 so it can be presented on the display 108 and accessed by the operator while operating the marine vessel 102.

The processing system 110 may also implement a boat preparation mode in which information representative of water storage data, fuel level data, hatch status data and/or other boat readiness data is presented on the display 108. The boat preparation mode may provide information related to a boat's readiness for use.

The processing system 110 may also implement a close quarters mode in which information representative of proximity data and navigation data is presented on the display 108. The close quarters mode may be particularly useful when navigating in a harbor or other confined area when an operator needs to be aware of his or her vessel's location relative to other vessels and obstacles. The close quarters mode may also present information from a pilot book, local speed limits, rules, regulations, and so forth, on the display 108.

The processing system 110 may also implement a docking/undocking mode in which information representative of proximity data from a proximity sensor, wind data from a wind sensor, water current data from a current sensor, rudder position data from a rudder position sensor, and/or azimuth thruster position data from an azimuth thruster position sensor is presented on the display 108. The docking/undocking mode permits an operator to view representations of obstacles such as stationary boats, docks, and other hazards while simultaneously monitoring wind conditions, current conditions, and the status of components on the vessel while docking or undocking the vessel. Additionally or alternatively, the docking/undocking mode may turn lights on or off, turn radar on or off, turn sonar on or off, or change any other appropriate settings for software, hardware and/or peripherals within or related to the marine vessel and/or its systems.

The processing system 110 may also implement a main transit mode in which information representative of fuel level data, navigation data, water depth data, and/or weather data is presented on the display 108. A feature of the main transit mode may be monitoring the progress of the marine vessel 102 against a journey plan. For example, the processing system 110 may compare information related to a desired path of transit with location data monitored while the marine vessel 102 is in transit to determine if the marine vessel 102 is off course, has enough fuel to reach its intended destination, and so forth, and may then display such information on the display 108. The main transit mode may also present information representative of nearby vessels, obstacles, and so forth.

The processing system 110 may also implement an anchoring mode in which information representative of the anchor status data, wind data, depth data, tide data, proximity data, and/or navigation is presented on the display 108. The anchoring mode may permit an operator to find suitable locations to anchor the marine vessel 102, and alert the operator if the anchor is dragging and/or if the marine vessel 102 is moving when it should not be.

The processing system 110 may also implement an off-boat monitoring mode in which information representative of security data, anchor status data, wind data, and/or weather data is presented on the display 108. In some embodiments, the marine vessel display system 100 may send texts, images, and so forth, to a remote device, such as an operator's mobile telephone or a computer, via a cellular telephone connection, radio frequency transmitter, the Internet, and so forth, so that the operator may monitor the marine vessel 102 remotely.

The processing system 110 may also implement a fishing mode in which information representative of fish finder data, water temperature data, navigation data, and/or proximity data is presented on the display 108. The fishing mode may allow an operator to view representations of fish, other boats, and hazards while fishing and to monitor water conditions to determine if they are conducive to fishing. In configurations, the processing system 110 may implement multiple fishing modes, each associated with information and settings specific to types of fish, depths of fish, or other appropriate situations. For example, if an operator is in a deep area, a fishing mode with a sonar frequency suitable for deep-water fishing may be automatically selected. In another example, if an operator is in a small channel, a fishing mode with a side-view sonar, such as Garmin SideVu, may be automatically selected. This may be especially useful to fisherman participating in tournaments, as the marine vessel display system 100 may automatically switch modes based on the section of the body of water in which they are currently located.

The processing system 110 may also implement a boat storage and transport mode in which information representative of photographic data, navigation data, and/or proximity data is presented on the display 108. As with the off-boat monitoring mode, the processing system 110 may display such information on the display 108 and/or transmit it to a remote device.

The processing system 110 may also implement a man overboard mode in which information representative of passenger location data and/or navigation data is presented on the display 108. The man overboard mode may display an alert and/or sound an alarm when any of the location devices worn by passengers indicate that a passenger is outside of a threshold distance from the marine vessel 102 and may have fallen overboard. The man overboard mode may also record and display the last known coordinates for the passenger when he or she left the marine vessel 102 and may automatically send such data to a marine rescue authority such as the United States Coast Guard or the like.

The processing system 110 may also implement a hazard hit mode in which information representative of bilge water level data is presented on the display 108. The hazard hit mode may allow an operator to quickly determine if the marine vessel 102 is taking on water and, if so, the rate at which the marine vessel 102 is taking on water. The hazard hit mode may also determine if a bilge pump can remove the water quickly enough to keep the marine vessel 102 afloat or if the marine vessel 102 should be abandoned. The hazard hit mode may also alert authorities such as the United States Coast Guard, or the like, of the marine vessel's 102 position and status.

The above-described modes of operation are only examples of modes that may be implemented by the processing system 110. Other modes of operation, or combinations or portions of the above-described modes, may also be implemented without departing from the scope of the invention.

In addition to displaying information from one or more selected marine input sources 116, each mode of operation may present information in a particular operator-selected or otherwise predetermined format. For example, some of the information may be presented in the form of one or more virtual devices that mimic the appearance and/or function of a gauge, instrument, or other analog device. Each virtual device may have a unique collection of graphical and functional properties that may be configured by a layout designer and/or adjusted by an operator. Examples of virtual devices that may be presented with the marine vessel display system 100 include a chartplotter, a radar screen, a fishfinder and/or other type of sonar, a camera/video screen, digital switching, digital instruments with numbers, analog instrument gauges, autopilot interfaces, and entertainment interfaces. In some embodiments, the display format may change based on a current operating mode. For example, if the selected mode of operation is changed from a first mode of operation, such as a navigation operating mode, to a second mode of operation, such as a docking, fishing, or planning mode of operation or other modes of operation, the display format may change accordingly to accommodate features relevant to the newly selected mode of operation. The change may be initiated by a user or automatically based on location or other data available to the marine vessel display system 100.

The position determining component 112 may be configured to provide location-determining functionality for the marine vessel display system 100 and, optionally, the marine input sources 116 and/or other system and components employed by the marine vessel 102. Location-determining functionality, for purposes of the following discussion, may relate to a variety of different navigation techniques and other techniques that may be supported by "knowing" one or more locations. For instance, location-determining functionality may be employed to provide location data, timing data, speed data, and/or a variety of other navigation-related data.

In implementations, the position-determining component 112 may comprise a receiver that is configured to receive signals from one or more position-transmitting sources. For example, the position determining component 112 may be configured for use with a Global Navigation Satellite system (GNSS). In embodiments, the position-determining component 112 may be a global positioning system (GPS) receiver operable to receive navigational signals from GPS satellites and to calculate a location of the marine vessel 102 as a function of the signals.

While a GPS system is described herein, it is contemplated that a wide variety of other positioning systems may also be used, such as terrestrial based systems (e.g., wireless-telephony systems or data systems that broadcast position data from cellular towers), wireless networks that transmit positioning signals, and so on. For example, positioning-determining functionality may be implemented through the use of a server in a server-based architecture, from a ground-based infrastructure, through one or more sensors (e.g., gyros or odometers), and so on. Other example systems include, but are not limited to, a Global Orbiting Navigation Satellite System (GLONASS), a Galileo navigation system, or other satellite navigation system.

The boundary definition component 118 may facilitate the definition of one or more boundaries of geographic areas or boundary lines with which one or more modes of operation are associated. These boundaries may be referenced to navigation information such as a map, a chart, geographic coordinates, combinations thereof, or the like, and cross-referenced with one or more associated modes of operation. Coordinate representations 604 of the geographic areas referenced to navigation information and associated modes of operation may then be stored in a database in a memory element by the processing system 110.

In one or more embodiments, the boundary definition component 118 may be implemented in hardware, software, firmware, or a combination thereof. For example, in one embodiment, the boundary definition component 118 may comprise software executed by the processor system 110, which allows geographic regions to be defined with reference to navigation information. Moreover, the mode selector 120 may comprise any device that interfaces with the processing system 110, and which may be used in defining the boundaries of geographic areas or boundary lines. For example, in embodiments, the mode selector 120 may employ a touchscreen 128 overlaying the display 108, the display 108, the position determining component 112, remote input devices such as the remote input device 130 shown in FIG. 7, inputs 114 for receiving information from marine input sources 116 (e.g., receivers for receiving geographic region information from a third party source, such as via the Internet, or the like), combinations thereof and so forth.

Figure 5A:
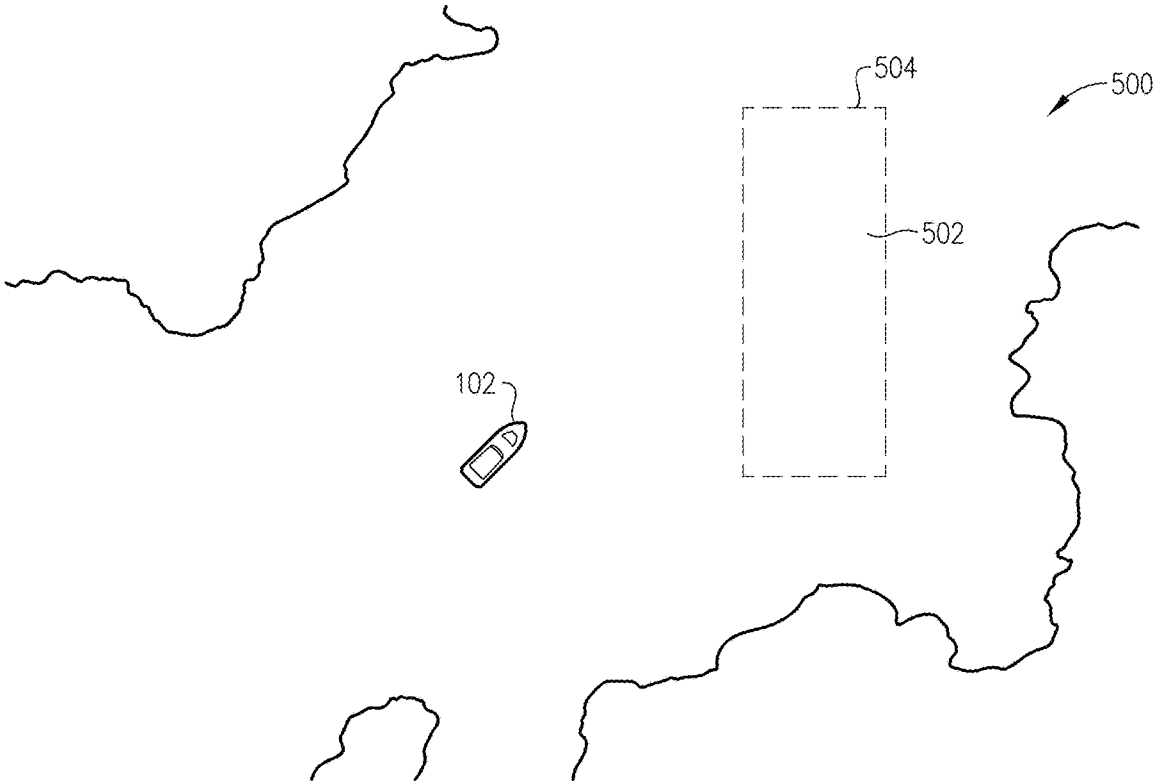
FIGS. 5A and 5B are schematic plan views illustrating an example environment in which the marine vessel display systems shown in FIGS. 1 and 2 may be employed.
Figure 5B:
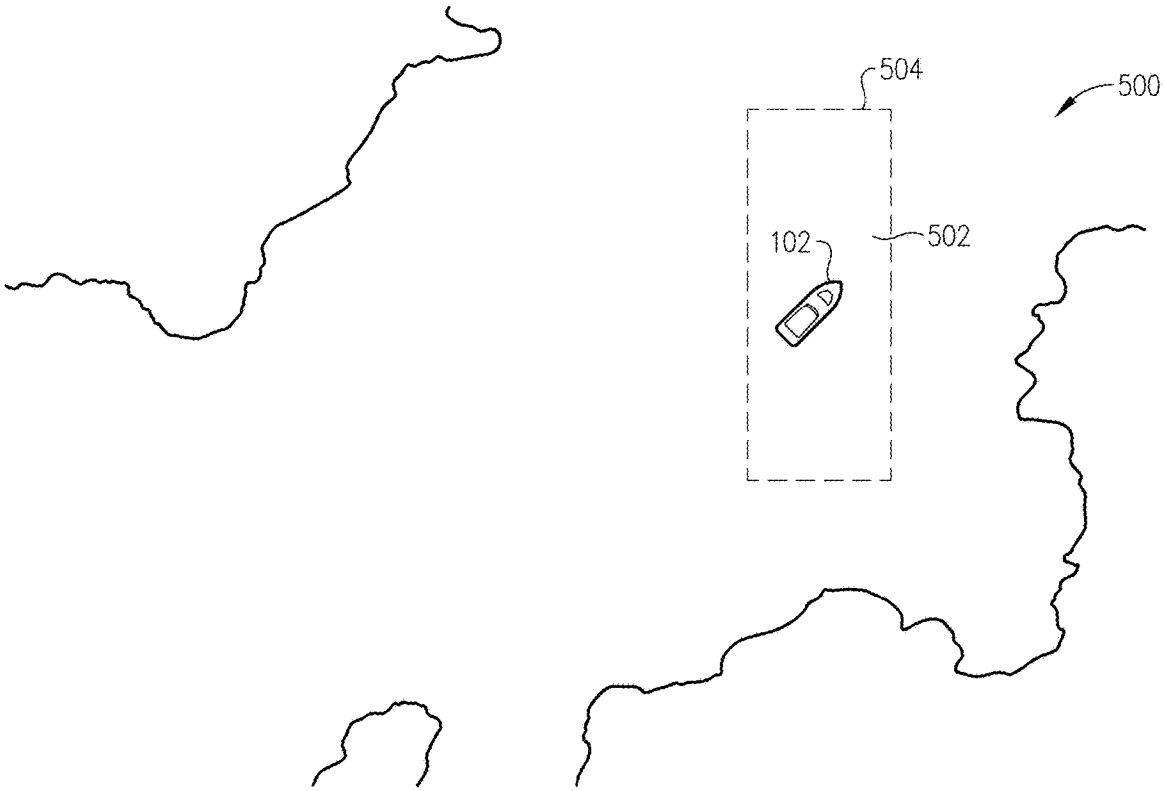

As shown in FIGS. 5A and 5B, a region 500 may contain one or more geographic areas 502, which may have characteristics that make the choice of one or more modes of operation of the marine vessel display system 100 desirable while the marine vessel 102 is located within the geographic area 502. For example, a geographic area 502 may be considered particularly desirable for fishing due to underwater currents, bottom features, water temperature, and the like. Thus, an operator may desire to select a fishing mode of operation when the marine vessel 102 moves from outside the geographic area 502, as shown in FIG. 5A, to within the geographic area 502, as shown in FIG. 5B. Similarly, a geographic area 502 may be considered particularly desirable for diving due to coral reef formations, a shipwreck, marine life, or the like. Thus, an operator may desire to select a diving mode of operation when the marine vessel 102 moves from outside the geographic area 502, as shown in FIG. 5A, to within the geographic area 502, as shown in FIG. 5B. In some embodiments, a geographic area 502 may be defined around a port, dock, or anchorage. Thus, an operator may desire to select a docking/undocking mode of operation when the marine vessel 102 moves from outside the geographic area 502, as shown in FIG. 5A, to within the geographic area 502, as shown in FIG. 5B.

Figure 6:
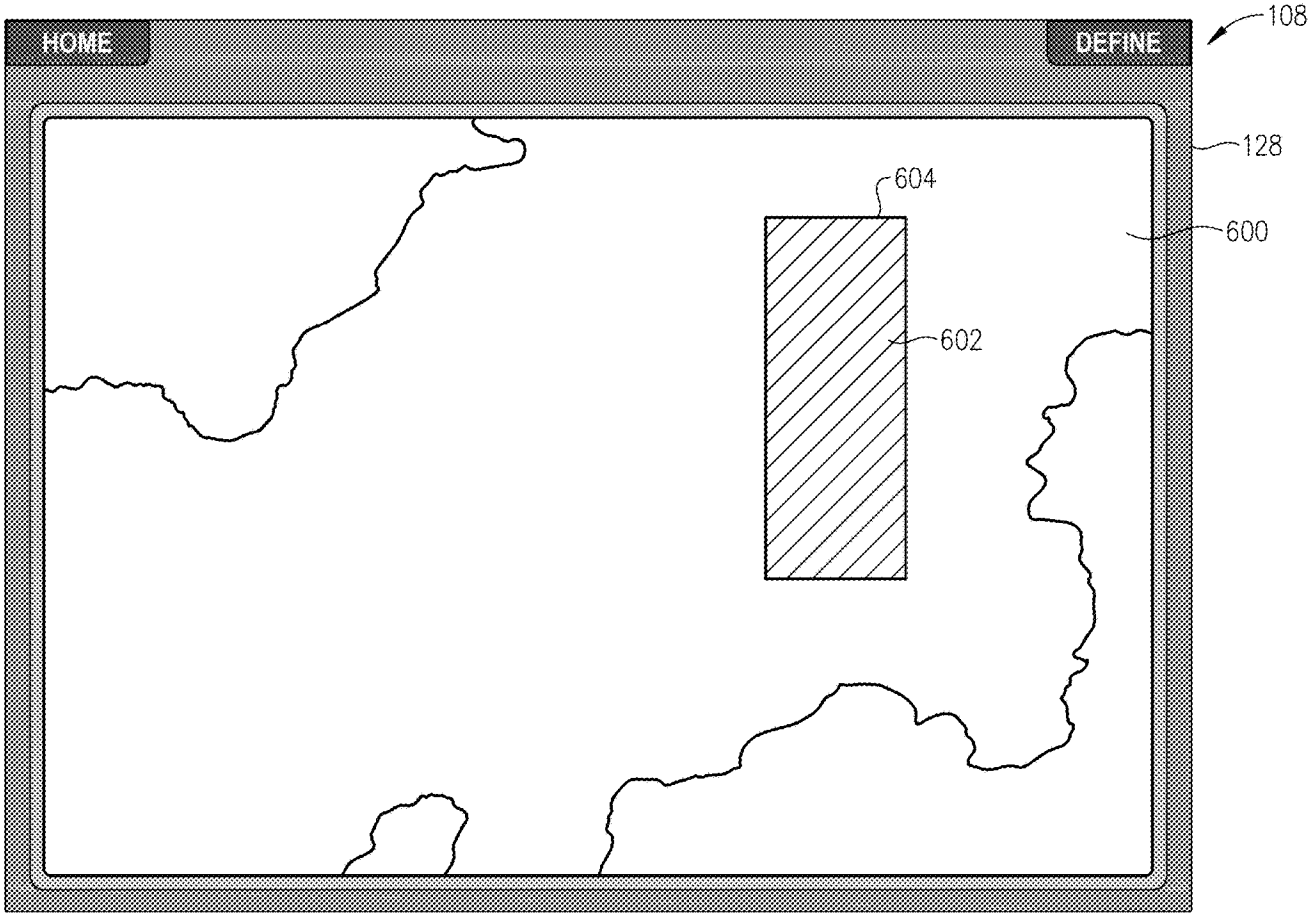
FIG. 6 is diagrammatic view illustrating an example screen display of the marine vessel display system of FIG. 1 or FIG. 2 configured to facilitate entry of boundaries for a geographic area.

As shown in FIG. 6, the boundary definition component 118 may be employed to generate a graphical representation 602 of the geographic area 502 by generating a coordinate representation 604 of the boundaries 504 of the geographic area 502, and to "associate" this graphical representation 602 with one or more modes of operation. In this manner, the marine vessel display system 100 may automatically select one or more modes of operation when the marine vessel display system 100 determines that the marine vessel 102 has entered the geographic area 502 (e.g., crossed a boundary 504 of the geographic area 502) wherein the one or more modes of operation are associated with the geographic area 502.

The boundary definition component 118 may employ a number of techniques to define the boundaries 504 of geographic areas 502 to be associated with one or more modes of operation. For example, in embodiments, the boundary definition component 118 can include a touchscreen 128 overlaying the display 108 that permits an operator to define the boundaries 504 of the geographic area 502 by drawing the coordinate representation 604 of the boundaries 504 of the geographic area 502 on a map or chart 600 displayed by the processing system 110 on the display 108. The operator may then assign a mode of operation to the coordinate representation 604 of the geographic area 502 by selecting a mode of operation displayed by the display 108.

The boundaries 504 of the geographic area 502, and the coordinate representation 604 thereof, may have any shape. For example, the coordinate representation 604 of the boundaries 504 may be drawn as segmented lines that join together to define the graphical representation 602 of the geographic area 502. In other examples, the coordinate representation 604 of the boundaries 504 may comprise a geometric shape such as a square, rectangle, circle, oval, or the like, that is pasted onto the map or chart via commands input into the touchscreen 128. In further examples, the coordinate representation 604 of the boundaries 504 may have an irregularly curved shape, or a shape comprised of a combination of curved and segmented sections.

The operator may draw the coordinate representation 604 of the boundaries 504 on the touchscreen 128 using a stylus, the operator's fingertip, or the like. In addition to (or instead of) the touchscreen 128, the marine vessel display system 100 may comprise other controls or inputs for inputting and/or defining the coordinate representations 604 of the boundaries 504. For example, the marine vessel display system 100 may include buttons, a track stick, a thumb stick, a trackball, a mouse, a keyboard, a keypad, switches, keys, voice recognition circuitry, or any other control devices capable of controlling or communicating information and/or commands to the processing system 110. The operator may also define coordinate representations 604 of the boundaries 504 or boundary lines by importing definitions created offline or otherwise obtained in a suitable format via any appropriate means (e.g., from an external device over an internet connection, from an SD card, and so on).

In other embodiments, the boundary definition component 118 may be furnished with pre-defined coordinate representation 604 of the boundaries 504 of important geographic areas 502 by the manufacturer of the marine vessel display system 100 or a third party such as a map or chart provider, or the like. For example, a map or chart provider may pre-define coordinate representations 604 of geographic areas 502 corresponding to ports, harbors, waterways, or the like, where it would be desirable to employ a docking mode of operation. Similarly, a manufacturer may pre-define coordinate representations 604 of geographic areas 502 corresponding to coral reefs or other underwater features where it could be desirable to employ a diving mode of operation. It is contemplated that, in embodiments employing pre-defined coordinate representations 604 of boundaries 504, the operator may define additional geographic areas 502 with associated modes of operation as described herein.

In further embodiments, the boundary definition component 118 may be configured to "learn" the boundaries 504 of geographic areas 502 for which one or more modes of operation are commonly employed. In this manner, the boundary definition component 118 may generate a coordinate representation 604 of the boundaries 504 of a geographic area 502 for which a mode of operation may be associated when it determines that the particular mode of operation is used repeatedly within the geographic area 502. The boundary definition component 118 may generate and store a coordinate representation 604 of the boundaries 504 of the geographic area 502 automatically, or may prompt the operator for confirmation prior to storing the coordinate representation 604 and associated mode of operation. For example, an operator may repeatedly visit a geographic area 502 that he or she believes is optimally suited for fishing, diving, or the like. Upon entering the geographic area 502 each time, the operator selects the desired mode of operation, e.g., fishing, diving, etc. The boundary definition component 118 may detect ("learn") this repeated behavior and, in response, generate a coordinate representation 604 of geographic area 502 which is associated with the selected mode of operation and stored in a database in memory of the processing system 110. In embodiments, the boundary definition component 118 may combine the recognition of repeated selection of a particular mode of operation within a geographic area 502 ("learning") with the recognition of known characteristics of the geographic area 502 such as current, water temperature, depth, bottom features, and so forth, to define the geographic area 502 and/or determine an appropriate or optimal mode of operation for the geographic area 502. In embodiments, the boundary information may be used to push useful information to the display 108 when the marine vessel 102 is within a geographic area, crosses a boundary into a geographic area, crosses a boundary line, and so on. This useful information may include, but is not limited to, traffic information, places of interest (POIs), rules or regulations (e.g., those of the United States Coast Guard), weather warnings, calls for help from nearby ships, and so on.

In still further embodiments, the boundary definition component 118 may be configured to receive coordinate representations 604 of the boundaries 504 of geographic areas 502 and associated modes of operation from a third party source. For example, the boundary definition component 118 may receive coordinate representations 604 of the boundaries 504 of geographic areas 502 and associated modes of operation from a paid service provided by the manufacturer of the marine vessel display system 100, a third party provider, a social network, or the like. In some embodiments, the coordinate representations 604 and associated modes of operation may be aggregated or pooled from the shared coordinate representations 604 and associated modes of operation from connected users of a social network of other marine vessel display system 100 operators.

In additional embodiments, the boundary definition component 118 may be configured to define the boundaries 504 of geographic areas 502 in which certain modes of operation may be disabled or otherwise prevent selection of the certain modes of operation. For example, the coordinate representation 604 of a geographic area 502 corresponding to a no fishing zone may be defined and associated with preventing the selection of or otherwise disabling access to the fishing mode while the marine vessel 102 is within the geographic area 502 (e.g., within the no fishing zone). Similarly, the coordinate representation 604 of a geographic area 502 corresponding to a no diving zone may be defined and associated with preventing the selection of or otherwise disabling access to the diving mode while the marine vessel 102 is within the geographic area 502 (e.g., within the no diving zone).

The mode selector 120 may select between the various modes of operation implemented by the processing system 110. In embodiments, the mode selector 120 may automatically select a mode of operation of the marine vessel display system 100 (and/or the marine vessel 102) based on the geographic position of the marine vessel 102 determined by the position determining component 112. For example, the mode selector 120 may be configured to select a first mode of operation (e.g., a fishing, diving, or docking mode of operation) when the geographic position data received from the position determining component 112 indicates that the marine vessel 102 has entered a first geographic area 502. This determination may be made, for example, when the geographic position data indicates that the marine vessel 102 has crossed a boundary 504 of the first geographic area 502 so that the marine vessel 102 is positioned within the first geographic area 502. The mode selector 120 may then cause the processing system 110 to automatically switch from the previous mode of operation (e.g., a navigation mode of operation) to the first mode of operation (e.g., a fishing mode of operation, a diving mode of operation, a docking mode of operation, etc.). The processing system 110 may then cause the display 108 to present information related to the selected first mode of operation in place of the information related to the previous mode of operation.

It will be appreciated based on the foregoing discussion, that the mode selector 120 may cause the processing system 110 to change the mode of operation of the marine vessel display system 100 from a current mode of operation to a desired mode of operation when the marine vessel 102 enters a defined geographic area 502 associated with the desired mode of operation. Moreover, when the marine vessel 102 leaves the geographic area 502, the mode selector 120 may cause the marine vessel display system 100 to be returned to the previous mode of operation or a default mode of operation. For example, the mode selector 120 may be configured to select a second mode of operation which may be a default mode of operation (e.g., the navigation mode of operation) when the geographic position data received from the position determining component 112 indicates that the marine vessel 102 has left the first geographic area 502. This determination may be made, for example, when the geographic position data indicates that the marine vessel 102 has crossed the boundary 504 of the first geographic area 502 so that the marine vessel 102 is no longer positioned within the first geographic area 502. The mode selector 120 may then cause the processing system 110 to automatically switch from the first mode of operation (e.g., a fishing mode of operation, a diving mode of operation, a docking mode of operation, etc.) to the second mode of operation. The processing system 110 may then cause the display 108 to present information related to the selected second mode of operation in place of the information related to the first mode of operation. The mode selector 120 may thereafter select a third mode of operation when the geographic position data received from the position determining component 112 indicates that the marine vessel 102 has entered a second geographic area (not shown). The mode selector 120 may then cause the processing system 110 to automatically switch from the second mode of operation to the third mode of operation while the marine vessel 102 is within the boundaries of the second geographic area. The processing system 110 may then cause the display 108 to present information related to the selected third mode of operation in place of information related to the first mode of operation.

In one or more embodiments, the mode selector 120 may be implemented in hardware, software, firmware, or a combination thereof. For example, in one embodiment, the mode selector may comprise software executed by the processor system 110. Moreover, the mode selector 120 may comprise any device that interfaces with the processing system 110.

In embodiments, the operator of the marine vessel 102 may override the selection of the mode of operation by the mode selector 120. For example, the operator may manually select a different mode of operation from the one automatically selected by the mode selector 120. As shown in FIGS. 9 and 10 and as described in more detail below, the processing system 110 may cause the display 108 and touchscreen 128 to present a mode selector screen 152 that permits an operator to select any one of the illustrated Navigation, Docking, Fishing, or Planning modes of operation or other modes of operation. In addition to (or instead of) the touchscreen 128, the marine vessel display system 100 may comprise other controls or inputs for controlling selection of the modes of operation or other operations of the display system 100. For example, the marine vessel display system 100 may include buttons, switches, keys, voice recognition circuitry, or any other elements capable of controlling the processing system 110.

The output 124 may be any wired or wireless port, transceiver, memory slot, or other device for transferring data or other information from the processing system 110 to the output devices 126. The output devices 126 may be any devices capable of receiving information from the processing system 110 or being controlled by the marine vessel display system 100 such as a marine radio, beacon, lighting system, and so forth.

Figure 7:
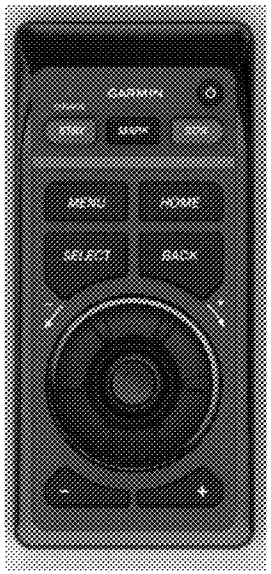
FIG. 7 is a plan view illustrating an example remote input device that may be employed by the marine vessel display system of FIG. 1 or FIG. 2.

The marine vessel display system 100 may also include a remote input device 130 for controlling and providing inputs to the processing system 110. An embodiment of the remote input device 130 is shown in FIG. 7. As shown, the remote input device 130 includes an analog joystick, thumb wheel, a mouse, or similar device for providing cursor movement and control and hard keys with pre-assigned functions such as Menu, Home, Select, and Back. The remote input device 130 may be particularly useful with embodiments of the marine vessel display system 100 that lack a touchscreen 128 user interface or that include displays 108 mounted in locations that prohibit the use of a touchscreen 128 overlaying the display 108.

In some embodiments, the remote input device 130 may provide input to the processing system 110 for content presented on more than one display 108 within marine vessel display system 100. For example, a remote input device 130 may be used to navigate across multiple displays 108 to provide input for information presented on a single display 108. In embodiments where a plurality of independent displays 108 are configured to be mounted adjacent to one another to form a plurality of display stations in the marine vessel 102, the remote input device 130 may provide input to the processing system 110 for the display stations to provide input for content presented on any display 108 included in the display stations. The remote input device 130 may include, for example, a mouse, pointer, keypad, joystick, trackpad, trackball, keyboard, combinations thereof, and the like.

The marine vessel display system 100 may also include a speaker for providing audible instructions and feedback, a microphone for receiving voice commands, an infrared port for wirelessly receiving and transmitting data and other information from and to nearby electronics, and other information, and a cellular or other radio transceiver for wirelessly receiving and transmitting data from and to remote devices.

In addition to the input 114 and output 124, the marine vessel display system 100 may also include a number of other Input/Output (I/O) ports that permit data and other information to be communicated to and from the processing system 110. The I/O ports may include one or more removable memory card slots, such as a micro SD card slot, or the like for receiving removable memory cards, such as microSD cards, or the like, and/or an Ethernet port for coupling a processing system 110 to another processing system such as a personal computer. Databases of geographic areas cross-referenced with modes of operation, navigational software, cartographic maps and other data and information may be loaded in the marine vessel display system 100 via the I/O ports, the wireless transceivers, or the infrared port mentioned above. The data may be stored in memory 106 of processing system 110. In some embodiments, stored cartographic maps may be upgraded, downgraded, or otherwise modified in the background without interfering with the primary uses of the marine vessel display system 100. If multiple processing systems 110 are employed by the marine vessel display system 100, the upgrade, downgrade, or modification may be applied to all processing systems 110. Thus, for example, the various components of the system 100 may be easily upgraded, downgraded, or modified without manually and tediously installing the same data on each of the components. Such functionality may also facilitate data uniformity among the various components of the marine vessel display system 100.

The marine vessel display system 100 may further include a housing that encloses and protects the other components of the marine vessel display system 100 from the environment (e.g., moisture, contaminants, vibration, impact, etc.). The housing may include mounting hardware for removably securing the marine vessel display system 100 to a surface within the marine vessel 102 or may be configured to be panel-mounted within the marine vessel 102. The housing may be constructed from a suitable lightweight and impact-resistant material such as, for example, plastic, nylon, aluminums, composites, steels, or any combination thereof. The housing may include appropriate gaskets or seals to make it substantially waterproof or water resistant. The housing may take any suitable shape or size, and the particular size, weight and configuration of the housing may be changed without departing from the scope of the present disclosure.

The marine vessel display system 100 described herein may be used to present information for any of the above-described modes of operation and other modes of operation. The mode selector 120 may automatically select a mode of operation of the marine vessel display system 100 (and/or the marine vessel 102) based on the geographic position of the marine vessel 102 determined by the position determining component 112 as described herein. An operator or other user may manipulate remote input device 130 or mode selector 120, which may be a touchscreen mode selector screen 152, to override the automatic selection, deselect the mode of operation, and thereafter select another of the modes of operation.

Figure 8:
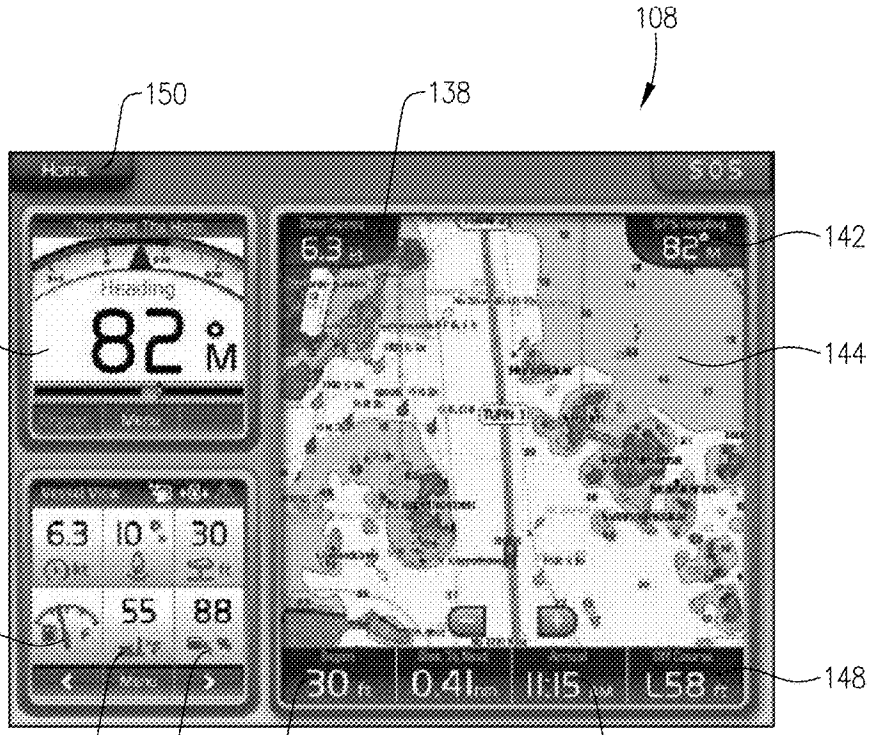
FIG. 8 is a diagrammatic view illustrating an example screen display of the marine vessel display system of FIG. 1.

FIG. 8 depicts the marine vessel display system 100 with a Main Transit or Navigation mode operation depicted on the display 108. In this embodiment, the mode of operation may present several virtual devices as well as textual and graphical information. For example, the mode of operation may present a virtual compass 129 or other heading instrument, a virtual fuel gauge 132, a virtual engine temperature indicator 134, a virtual fuel level indicator 136, a boat speed indicator 138, a water depth indicator 140, a GPS heading indictor 142, a cartographic map 144 with a route shown thereon, an estimated arrival indicator 146, an off course indicator 148, and other indicators as shown.

To switch to a different operating mode, the operator may press a "Home" button 150, icon, or other input on the display 108 to present a mode selector screen 152 as shown in FIG. 9. The mode selector screen 152, as illustrated in FIGS. 9 and 10, may present buttons, icons, or other selectors for various different modes of operation as shown. The operator may communicate a touch input to a touchscreen 128 overlaying the display 108 or otherwise select any of the displayed modes of operation to present information related to the mode of operation on the display 108. For example, the operator may select a Fishing mode of operation as shown in FIG. 10 to cause the display 108 to present information tailored to the Fishing mode of operation as shown in FIG. 11. In the Fishing mode of operation, the display 108 may present a fish finder display 154, a cartographic map 156, a boat speed indicator 158, a heading indicator 160, a fuel level indicator 162, an engine RPM indicator 164, and other indicators as shown. The user may press the Home button 166 as illustrated in FIG. 11 at any time to again view the mode selector screen 152 shown in FIG. 9.

The above-described marine vessel display system 100 may automatically select a mode of operation to view information relevant to the selected mode of operation without requiring input from an operator (such as manually selecting a mode, looking for individual instruments, gauges, read-outs, and so forth). The marine vessel display system 100 may also permit an operator to quickly and easily switch between modes of operation to view information from other input sources. The marine vessel display system 100 may thus provide an operator with large amounts of information that may be presented on a single display while also simplifying access to the information.

Figure 2:
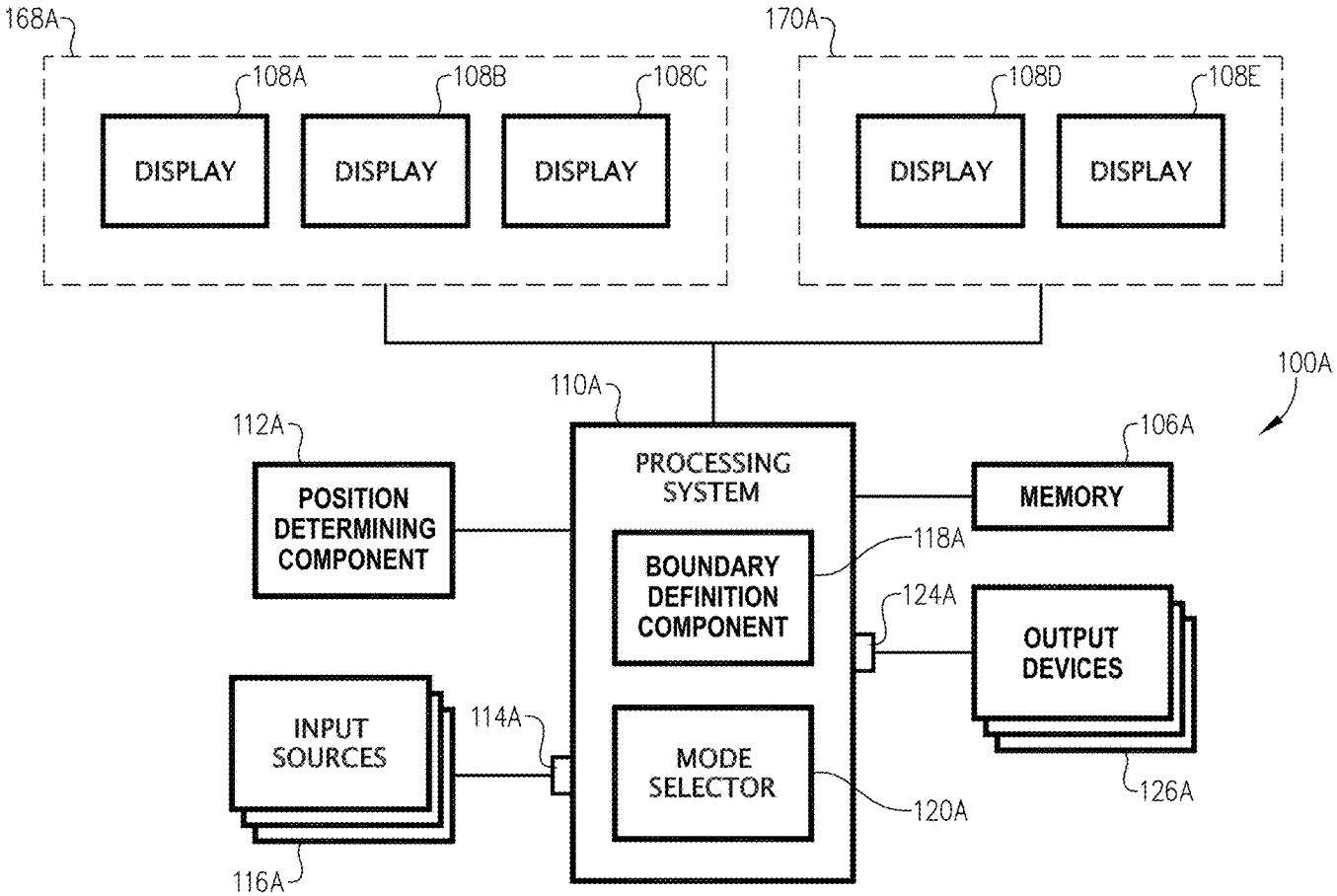
FIG. 2 is a block diagram of illustrating example components of a marine vessel display system constructed in accordance with another embodiment of the technology.
Figure 4:
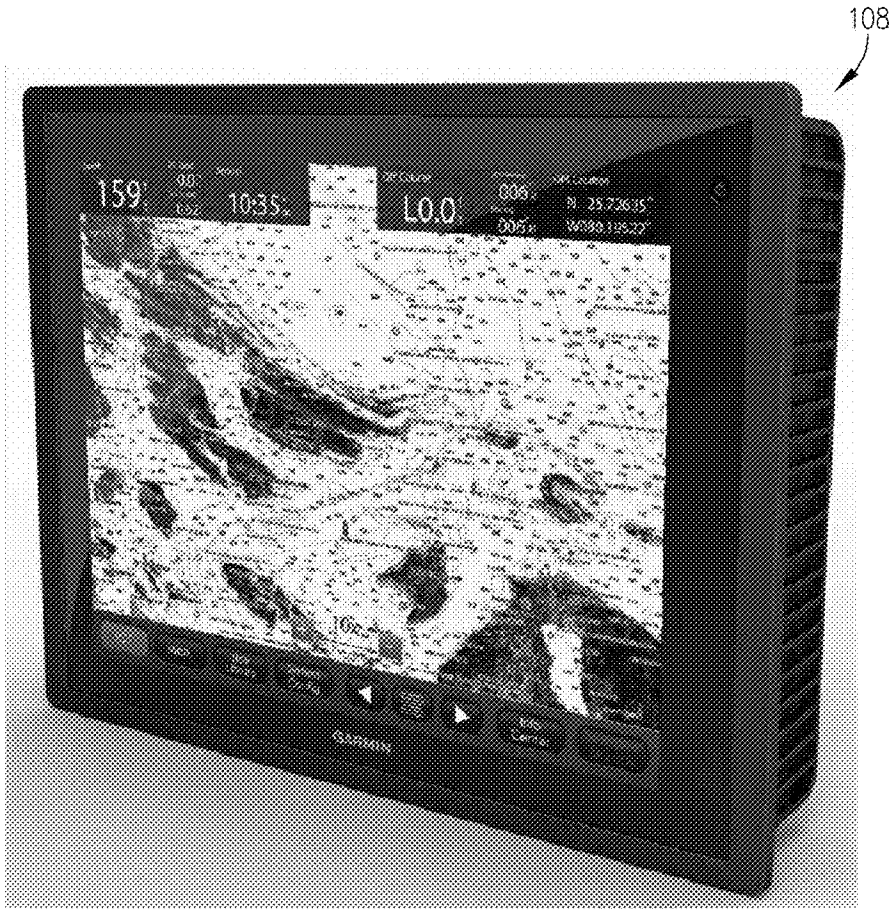
FIG. 4 is a perspective view illustrating an example display that may be employed by the marine vessel display system of FIG. 1 or FIG. 2.
Figure 3:
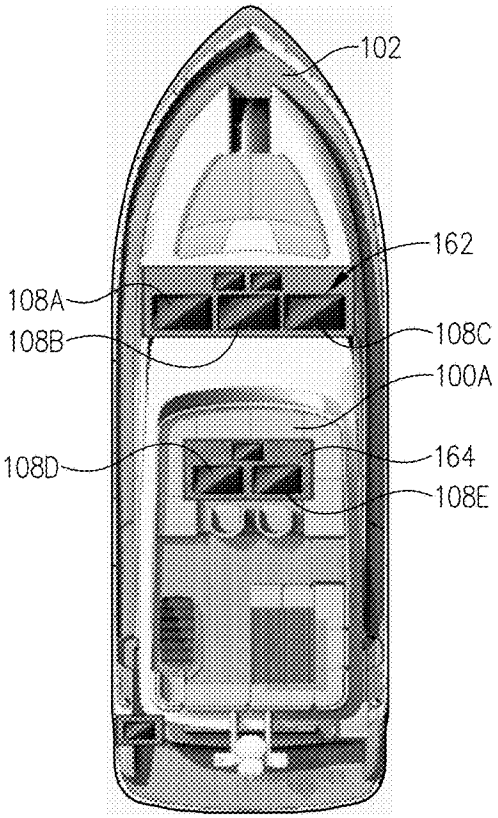
FIG. 3 is a schematic plan view illustrating an example marine vessel in which embodiments of the marine vessel display system may be installed.

FIG. 2 illustrates a marine vessel display system 100A in accordance with another embodiment of the technology. The marine vessel display system 100A is similar to the marine vessel display system 100 except that it employs a plurality of independent displays 108A-E configured to be mounted proximate (e.g., adjacent) to one another to form one or more display stations in the marine vessel 102. For example, as illustrated in FIGS. 2 and 3, three displays 108A, 108B, 108C may be mounted together to form a first display station 168A in a first area of the marine vessel 102, and two other displays 108D, 108E may be mounted together to form a second display station 170A in a second area of the marine vessel 102. The marine vessel display system 100A may also include additional displays 108 grouped into one or more additional display stations.

A processing system 110A, which may be similar to the processing system 110 described above in the discussion of FIG. 1, may be coupled with the displays 108A-E and may be operable to implement the modes of operation as described above. It is to be understood that the processing system 110A may be any configuration of processors that enables communication with one or more displays 108A-E. Each display 108A-E and/or display station 168A, 170A may have a separate processing system 110A, or one processing system 110A may control all displays 108A-E of both display stations 168A, 170A and other display stations, or any combination thereof. In embodiments, the processing systems 110A may coordinate their activities with other processing systems 110A of the marine vessel display system 100A. The processing system 110A may include any number of processors, micro-controllers, or other processing systems and resident or external memory for storing data and other information accessed or generated by the marine vessel display system 100A.

A position determining component 112A, which may be similar to the position determining component 112 described in the discussion of FIG. 1 above, may be configured to provide location-determining functionality for the marine vessel display system 100A and, optionally, the marine input sources 116A and/or other system and components employed by the marine vessel 102. In implementations, the position determining component 112A may comprise a receiver that is configured to receive signals from one or more position-transmitting sources. For example, the position determining component 112A may be configured for use with a Global Navigation Satellite system (GNSS). In embodiments, the position determining component 112A may be a global positioning system (GPS) receiver operable to receive navigational signals from GPS satellites and to calculate a location of the marine vessel 102 as a function of the signals.

A boundary definition component 118A may facilitate the definition of one or more boundaries 504 of geographic areas 502 with which one or more modes of operation are associated. These boundaries 504 may be referenced to navigation information such as a map, a chart, geographic coordinates, combinations thereof, or the like, and cross-referenced with one or more associated modes of operation. Coordinate representations 604 of the geographic areas 502 referenced to navigation information and associated modes of operation may then be stored in a database in a memory element by the processing system 110A. The boundary definition component 118A may use a variety of techniques for defining the boundaries 504 of geographic areas 502 with which modes of operation are associated. Example techniques are discussed in the description of the boundary definition component 118 of the marine vessel display system 100 shown in FIG. 1. In embodiments, the boundary definition component 118A may function and be implemented in a similar fashion to the boundary definition component 118 described in the discussion of the marine vessel display system 100 shown in FIG. 1.

A mode selector 120A may select between the various modes of operation implemented by the processing system 110A. In embodiments, the mode selector 120A may automatically select a mode of operation of the marine vessel display system 100A (and/or the marine vessel 102) based on the geographic position of the marine vessel 102 determined by the position determining component 112A. For example, the mode selector 120A may be configured to select a mode of operation (e.g., a fishing, diving, or docking mode of operation) when the geographic position data received from the position determining component 112A indicates that the marine vessel 102 has entered a geographic area 502. This determination may be made, for example, when the geographic position data indicates that the marine vessel has crossed a boundary 504 of the geographic area 502 so that the marine vessel 102 is positioned within the geographic area 502. The mode selector 120A may then cause the processing system 110A to automatically switch from the previous mode of operation (e.g., a navigation mode of operation) to the selected mode of operation (e.g., a fishing mode of operation, a diving mode of operation, a docking mode of operation, etc.). The processing system 110A may then cause the displays 108A-E to present information related to the selected mode of operation in place of information related to the previous mode of operation. The mode selector 120A may function and be implemented in a similar fashion to the mode selector 120 described in the discussion of the marine vessel display system 100 shown in FIG. 1.

In embodiments, the operator of the marine vessel 102 may override the selection of the mode of operation by the mode selector 120A. For example, in embodiments of the technology, one of the displays 108A-E in each display station 168A, 170A may include a touchscreen user interface and may be designated as a primary control display. For example, the display 108B may be designated as the primary control display for the display station 168A. As shown in FIGS. 9 and 10 and as described in more detail herein, the processing system 110A may cause a primary display 108B and touchscreen 128 to present a mode selector screen 152 that permits an operator to select any one of the illustrated Navigation, Docking, Fishing, or Planning modes of operation or other modes of operation. In addition to (or instead of) the touchscreen 128, the marine vessel display system 100A may comprise other controls or inputs for controlling selection of the modes of operation or other operations of the marine vessel display system 100A. For example, the marine vessel display system 100A may include buttons, switches, keys, voice recognition circuitry, and/or any other elements capable of controlling the processing system 110A.

Figure 17:
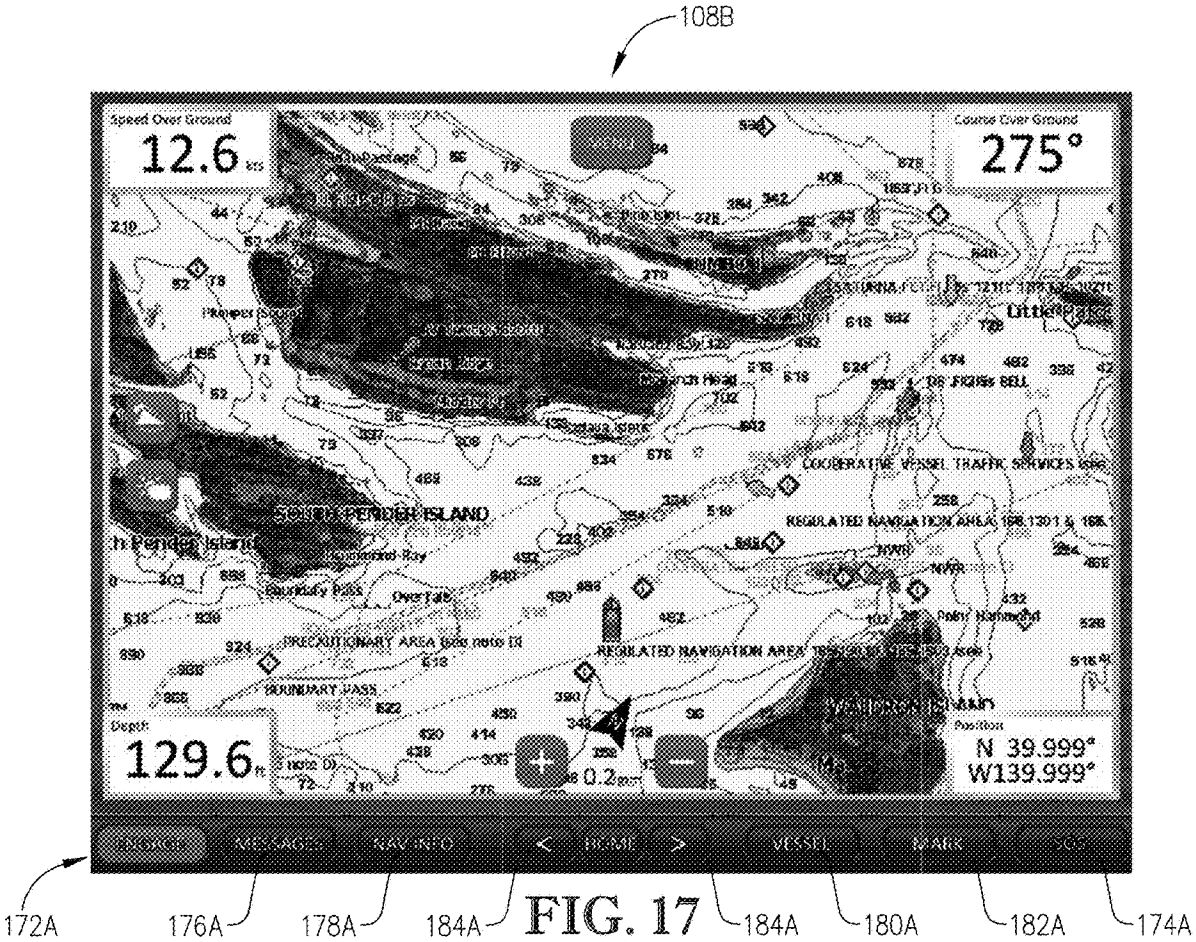
FIG. 17 is a diagrammatic view illustrating an enlarged screen display of a primary control display showing a station control center displayed thereon.

In embodiments, such as the embodiment shown in FIG. 17, the processing system 110A may display a station control center 172A on the primary control display 108B. The station control center 172A may implement several controls that are commonly used while operating the display station. The specific controls in the station control center 172A may vary for each installation or station configuration, but it is contemplated that certain controls may be desired for most applications. Thus, in one embodiment, the station control center 172A may be configured to include an emergency ("SOS") button 174A or icon that may be labeled "SOS" or the like. Selection of this SOS button 174A may cause a pop-up menu to be provided that contains information and controls required to address common ship emergencies and/or allows the operator to select the nature of a specific emergency. The marine vessel display system 100A may also provide the operator with guidance for precautions to be taken and activities to avoid for the type of emergency selected. In some embodiments, the guidance may be step-by-step instructions of how to properly address an emergency. For example, guidance may include instructions about how to rescue a man overboard, place a distress call on an integrated or external VHF radio, provide CPR, and so forth. When the processing system 110A detects the presence of a radio capable of being set up for digital selective calling (DSC), the processing system 110A readies the marine vessel display system 100A for the call and may cause the primary display 108B to present information that instructs the operator in how to complete the call. All other devices connected with or in communication with the display system 100A may similarly be configured or controlled according to the nature of the emergency. It is contemplated that the SOS button 174A may provide information for any emergency including, but not limited to, general distress, fire, flooding, collision, grounding, capsizing, sinking, adrift abandoning, piracy, and man overboard.

The station control center 172A may also include a "MESSAGES" button 176A, which, when selected, may cause an Information Center to be accessed. An embodiment of the marine vessel display system 100A may support the provision of three distinct classifications of information via the Information Center, including:

i. Alarms. Event that demands immediate attention.

ii. Warnings. Event that will require attention at some point.

iii. Messages. Event that is informational only and does not require attention.

The Information Center may display a pop-up interface dialog that provides access to the system information and interfaces that may include, but is not necessarily limited to, the following: a list of "active" alarms, warnings, and messages with ability to access details about each; software, map, and other versions for every device on the vessel connected to the display system; access to status of all networks and information about network devices; GPS status, signal conditions, and Skyview; weather receiver status, signal conditions, and information a user may need for activation; system diagnostics, faults, exceptions, and so forth; and/or access to a unified interface for all types of user-adjustable alarms to facilitate review and/or setup.

The station control center 172A may also include a "NAV INFO" button 178A for triggering a Navigator's Library. The Navigator's Library may provide access to information and interfaces related to boating in general as opposed to the system information accessed via the Information Center. The NAV INFO button 178A may enable a pop-up dialog that provides access to a variety of tools and "dashboards" commonly used for vessel navigation functions. An embodiment of the Navigator's Library may provide access to information related to functions and features including, but not necessarily limited to, the following: tides, currents, and/or celestial data; planning charts; weather charts; active track recording and/or track log management; user data management; fuel management; trip computer; and/or historical/performance data (logs, graphs, statistics, etc.).

In embodiments, the station control center 172A may also include a "VESSEL" button 180A that provides an interface to the installation, layout configuration, network setup and installation, vessel information, and user preference interfaces of the marine vessel display system 100A. These interfaces may be designed to be lockable by the layout designer.

In embodiments, the station control center 172A may also include a "MARK" button 182A or icon that may be used to mark the marine vessel's 102 current geographic coordinates as a new waypoint. This marking interface may allow for automatic naming and provide means for user naming and/or setting other user waypoint preferences.

The marine vessel display system 100A may support an autopilot interface. In embodiments, the autopilot interface may not always be visible or directly accessible to the operator of the marine vessel display system 100A. Therefore, access to an unobstructed Standby/Engage button as part of the station control center 172A may facilitate safe autopilot operation. Thus, the station control center 172A can be configured to include an Autopilot Standby/Engage button when an autopilot control device (such as the GHC10 manufactured by Garmin) is detected or when an autopilot control has been set up in any of the layout configurations for a particular station. When an autopilot control is configured in any layout at the station, the Autopilot Standby/Engage button may be included in the station control center for that station.

The station control center 172A may also include an interface or one or more buttons for changing the layout of a mode of operation screen or the layout of the display station. The interface may allow an operator to optimize the installation of the marine vessel display system 100A for larger vessels when the operator desires the experience of having a dedicated hard display for each function of a mode of operation. The one or more layout selection buttons 184A may be labeled "NEXT," "PREVIOUS," "LIST," or include back and forward arrow icons, combinations thereof, or the like. The layout selection buttons 184A may switch between "pages" of a particular mode of operation or between several modes of operation.

As with the marine vessel display system 100, the display system 100A may be used to display information for any of the above-described modes of operation. In embodiments, the mode selector 120A automatically selects a mode of operation of the marine vessel display system 100A (and/or the marine vessel 102) based on the geographic position of the marine vessel 102 determined by the position determining component 112A. An operator or other user may operate the touchscreen display of the primary control display 108B, remote input device 130 as shown in FIG. 7, or other mode selector 120A to override this selection and select another mode of operation to present information related to that operating mode. The operator or user may then manipulate the elements identified above to switch to a different operating mode.

Figure 12:
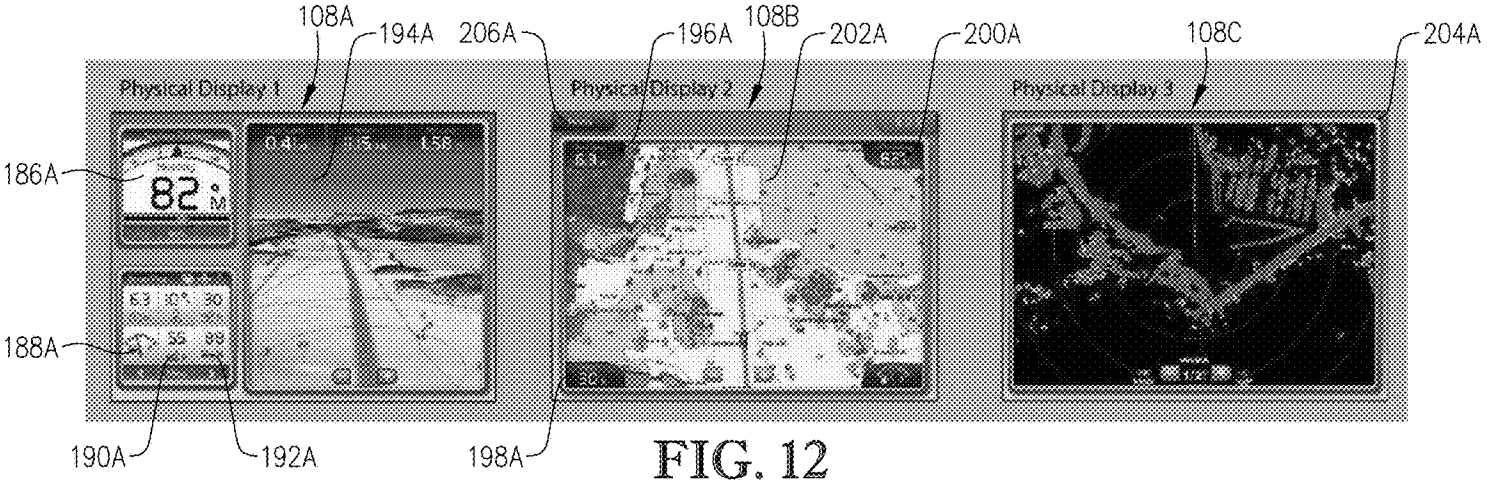
FIG. 12 is a diagrammatic view illustrating three example screen displays provided by three displays of a display station of the marine vessel display system shown in FIG. 2.

FIG. 12 depicts the marine vessel display system 100A with a Main Transit or Navigation mode of operation depicted on the three displays 108A, 108B, 108C. As described above, the Main Transit or Navigation mode of operation may cause the display of several virtual devices as well as textual and graphical information. For example, the Main Transit or Navigation mode of operation may cause the display 108 to display a virtual compass 186A or other heading instrument, a virtual fuel gauge 188A, a virtual engine temperature indicator 190A, a virtual fuel level indicator 192A, a cartographic map 194A, and/or other indicators on the first display 108A. The Main Transit or Navigation mode of operation may also cause the display 108 to display a boat speed indicator 196A, a water depth indicator 198A, a GPS heading indicator 200A, and/or a cartographic map 202A on the primary (second) display 108B. The mode may also cause the display of a radar map 204A and/or other indicators on the third display 108C.

Figure 13:
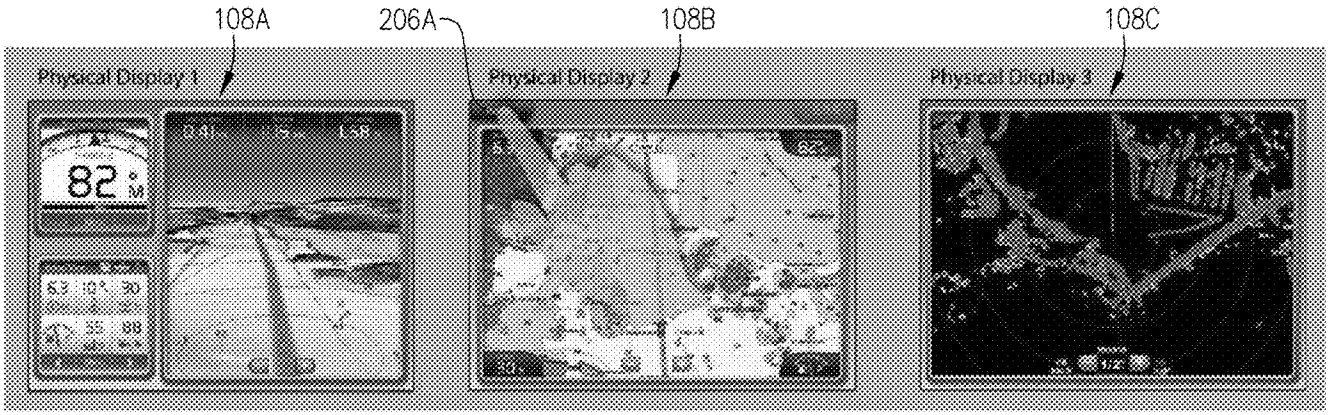
FIG. 13 is a diagrammatic view illustrating three example screen displays provided by three displays of a display station of the marine vessel display system shown in FIG. 2.
Figure 14:
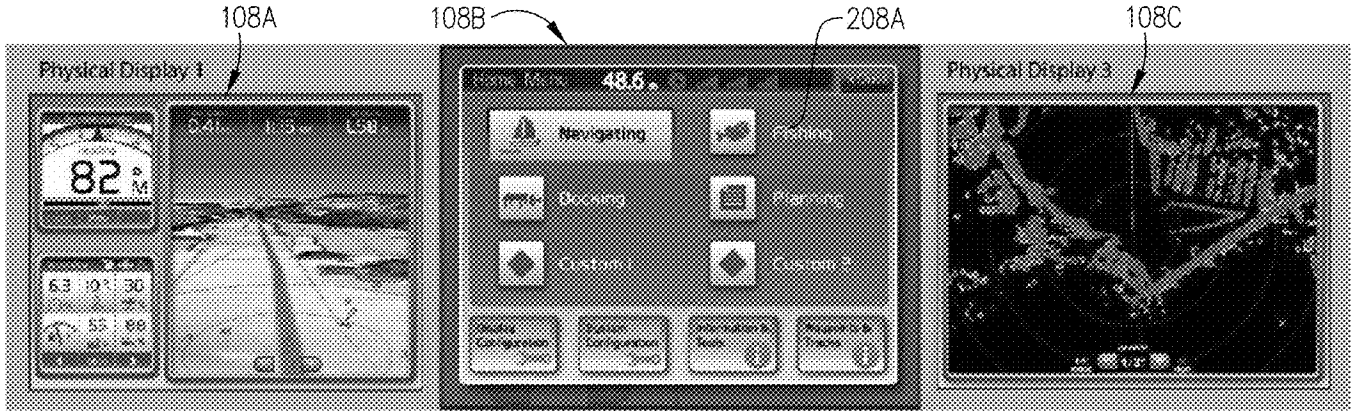
FIG. 14 is a diagrammatic view illustrating three example screen displays provided by three displays of a display station of the marine vessel display system shown in FIG. 2.
Figure 15:
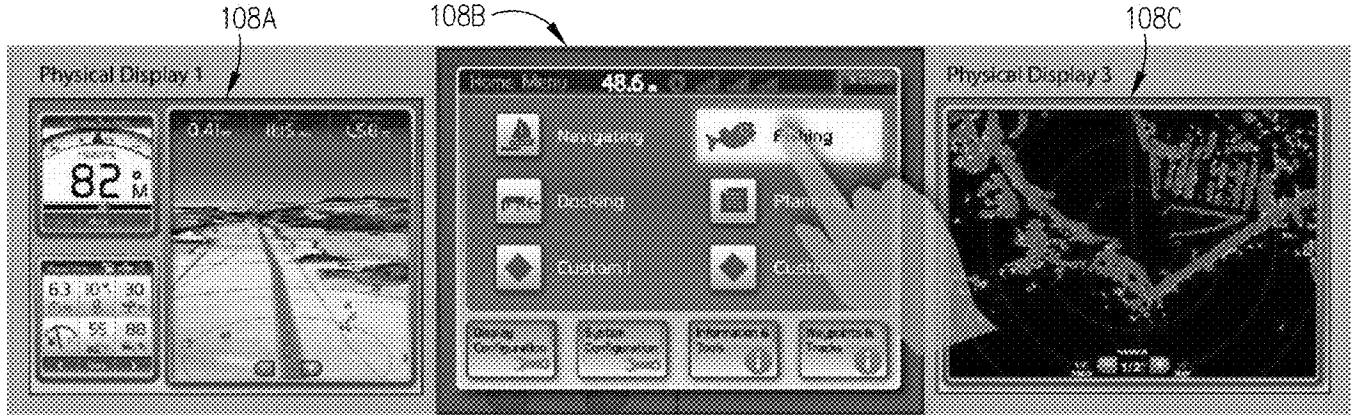
FIG. 15 is a diagrammatic view illustrating three example screen displays provided by three displays of a display station of the marine vessel display system shown in FIG. 2.
Figure 16:
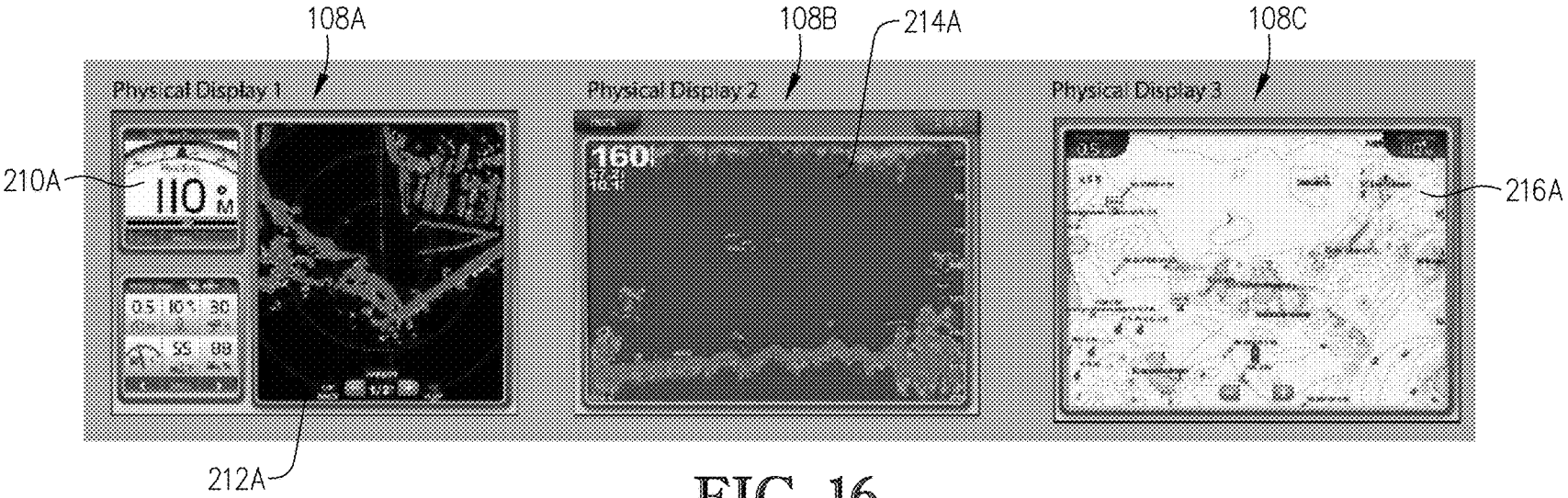
FIG. 16 is a diagrammatic view illustrating three example screen displays provided by three displays of a display station of the marine vessel display system shown in FIG. 2.

To switch to a different mode of operation, the operator may access the mode selector 120A via information displayed by a display 108. In some embodiments, the operator may press a "HOME" button 206A, icon, or other input on the primary display 108B as shown in FIGS. 12 and 13. Pressing the HOME button 206A may cause a mode selector screen 208A to be presented on the primary control display 108B as shown in FIG. 14. The operator may then select a mode of operation, such as the Fishing mode of operation shown in FIG. 15, to cause the displays 108A, 108B, 108C to present information tailored to a Fishing mode of operation. In the Fishing mode of operation, as shown in FIG. 16, the processing system 110A may cause the display 108A to present a virtual heading indicator 210A, a radar screen 212A and other information; the display 108B to present a fish finder or sonar display 214A; and the display 108C to present a cartographic may 216A and other information. In some embodiments, the processing system 110A may cause the display 108A to also present a boat speed indicator, a leading indicator, a fuel level indicator, and/or an engine RPM indicator. In some embodiments, the processing system 110A may cause certain changes to settings of software, hardware and/or peripherals within or related to the marine vessel and/or its systems, such as to turn on a fish finder or sonar.

The marine vessel display system 100, 100A may coordinate settings and content presented on the displays 108, 108A-E of the marine vessel display system 100, 100A. In embodiments, the coordinate representations 604 of the boundaries 504 of defined geographic areas 502 cross-referenced with associated modes of operation, mode of operation settings, cartographic data, and the mode of operation content currently associated with a display 108 may be stored in memory 106, 106A of processing system 110, 110A. This information and any other data utilized by the marine vessel display system 100, 100A may be automatically repopulated if one of the displays 108 or other system components fail, or if the mode of operation display settings, cartographic information, and mode of operation content are moved from one display 108 to another display 108. Thus, instead of requiring each of the displays 108 to be separately configured, the processing system 110, 110A may automatically transfer configuration information, system data, cartographic information, and the like to the various system 100, 100A components upon installation, reconfiguration, failure, or the like.

The above-described embodiments and other embodiments of the marine vessel display system 100, 100A may also include other features. For example, the processing system 110, 110A may automatically detect all marine input sources 116, 116A, output devices 126, 126A, and other devices connected to the marine vessel display system 100, 100A and provide a list of these devices to be used for configuration and set-up purposes. The processing system 110, 110A may also allow an operator to assign certain marine input sources 116, 116A to each display station so that information communicated from some of the marine input sources 116, 116A is only displayed on the certain designated display stations. For example, the display stations may be configured so that sonar information is presented on some of the display stations but not all of them. Similarly, the display stations may be configured to enable only specified modes of operation. For example, a Fishing mode of operation may be accessed from a first display station but not a second display station.

The processing system 110, 110A may also allow an installer or configuration person to create custom layouts for the modes of operation. An installer and/or designer may, for example, select the size, position, and name of all buttons, virtual devices, etc., for each mode of operation.

The foregoing detailed description of various embodiments of the present technology references the accompanying drawings which illustrate specific embodiments in which the technology can be practiced. The embodiments are intended to describe aspects of the technology in sufficient detail to enable those skilled in the art to practice them. Other embodiments can be utilized and changes can be made without departing from the scope of the technology. The forgoing detailed description is, therefore, not to be taken in a limiting sense. The scope of the present technology is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, and so forth described in one embodiment may also be included in other embodiments, but is not necessarily included. Thus, the present technology can include a variety of combinations and/or integrations of the embodiments described herein.

Although the technology has been described with reference to the embodiments illustrated in the attached drawing figures, equivalents may be employed and substitutions made herein without departing from the scope of the technology as recited in the claims. For example, the components described herein need not be physically connected to one another since wireless communication among the various depicted components is permissible and intended to fall within the scope of the present invention. Components illustrated and described herein are merely examples of a device and components that may be used to implement the embodiments of the present invention and may be replaced with other devices and components without departing from the scope of the invention.

What is claimed is:

1. A display system for a marine vessel, the display system comprising:

a memory including geographic position data for a geographic area;

a position determining component for determining a current geographic position of the marine vessel;

a display; and a processing system coupled with the memory, the position determining component, and the display, the processing system operable to implement a plurality of modes of operation for the display system, wherein the processing system is configured to:

select a mode of operation based on a comparison of the current geographic position of the marine vessel to the geographic area, cause the display to present information related to the selected mode of operation, and cause at least one of automatic activation of or automatic deactivation of an equipment of the marine vessel based on the selected mode of operation.

2. The display system as recited in claim 1, further comprising a touchscreen overlaying the display, wherein the geographic area is defined via input of a boundary of the geographic area using the touchscreen and thereafter stored in the memory.

3. The display system as recited in claim 1, wherein the processing system is configured to learn the geographic area and cause the learned geographic area to be stored in the memory, the processing system automatically associating the mode of operation with the learned geographic area.

4. The display system as recited in claim 3, wherein the mode of operation is associated with the learned geographic area based on a historical pattern of behavior when the marine vessel is within the learned geographic area.

5. The display system as recited in claim 3, wherein the memory is configured to store map information, and wherein the geographic area is learned based on a characteristic of the map information.

6. The display system as recited in claim 1, wherein the geographic area is determined based on information furnished by one or more third parties via an external network.

7. The display system as recited in claim 1, wherein the processing system is configured to cause the display to present at least one preselected window providing information related to the selected mode of operation.

8. A display system for a marine vessel, the display system comprising:

a memory including geographic position data for a geographic area;

a position determining component for determining a current geographic position of the marine vessel;

a display station configured to be mounted in the marine vessel, the display station comprising a plurality of displays; and a processing system coupled with the memory, the position determining component, and the display station, the processing system operable to implement a plurality of modes of operation for the display system, wherein the processing system is configured to:

select a mode of operation based on a comparison of the current geographic position of the marine vessel to the geographic area, cause one or more of the displays of the display station to present information related to the selected mode of operation, and cause at least one of automatic activation of or automatic deactivation of a radar of the marine vessel based on the selected mode of operation.

9. The display system as recited in claim 8, further comprising a touchscreen overlaying at least one of the displays of the display station, wherein the geographic area is defined via input of a boundary of the geographic area using the touchscreen and thereafter stored in the memory.

10. The display system as recited in claim 8, wherein the processing system is configured to learn the geographic area and cause the learned geographic area to be stored in the memory, the processing system automatically associating the mode of operation with the learned geographic area.

11. The display system as recited in claim 10, wherein the mode of operation is associated with the learned geographic area based on a historical pattern of behavior when the marine vessel is within the learned geographic area.

12. The display system as recited in claim 10, wherein the memory is configured to store map information, and wherein the geographic area is learned based on a characteristic of the map information.

13. The display system as recited in claim 8, wherein the geographic area is determined based on information furnished by one or more third parties via an external network.

14. The display system as recited in claim 8, wherein the processing system is configured to cause one or more of the displays of the display station to present at least one preselected window providing information related to the selected mode of operation.

15. A method for controlling a marine vessel having a display system including at least one display comprising:

retrieving, using a processing system, geographic position data for a geographic area from a memory;

receiving, using the processing system, a current geographic position of the marine vessel from a position determining component;

selecting, using the processing system, a mode of operation for the display system based on a comparison of the current geographic position of the marine vessel to the geographic area, the mode of operation being selected from a plurality of modes of operation for the display system;

causing, using the processing system, a display of the display system to present information related to the selected mode of operation; and causing, using the processing system, at least one of automatic activation of or automatic deactivation of a radar of the marine vessel based on the selected mode of operation.

16. The method as recited in claim 15, wherein the geographic area is defined via input of a boundary of the geographic area using a touchscreen overlaying the display and thereafter stored in the memory.

17. The method as recited in claim 15, further comprising learning, using the processing system, the geographic area and automatically associating the mode of operation with the learned geographic area.

18. The method as recited in claim 17, wherein the mode of operation is associated with the learned geographic area based on a historical pattern of behavior when the marine vessel is within the learned geographic area.

* * * * *